United States Patent [19]

Jaunin

[11] 4,255,805

[45] Mar. 10, 1981

[54] DATA INTRODUCING ARRANGEMENT

[75] Inventor: Jean-Pierre Jaunin, La Neuveville, Switzerland

[73] Assignee: Societe Suisse Pour l'Industrie Horlogere Management Services S.A., Bienne, Switzerland

[21] Appl. No.: 24,299

[22] Filed: Mar. 27, 1979

Related U.S. Application Data

[63] Continuation-in-part of Ser. No. 897,603, Apr. 18, 1978, abandoned.

[51] Int. Cl.[3] ..... G04F 3/06; G04C 9/08

[52] U.S. Cl. ..... 368/108; 368/188; 235/92 PE

[58] Field of Search ..... 58/21.13, 4 A, 38 R, 58/38 A, 58, 23 R, 39.5, 50 R, 85.5; 235/92 T, 92 TF, 92 PE; 324/186

[56] References Cited

U.S. PATENT DOCUMENTS

| | | | |
|---|---|---|---|
| 3,976,859 | 8/1979 | Christie et al. | 235/92 PE |
| 4,005,571 | 2/1977 | Wolff | 58/39.5 |
| 4,022,017 | 5/1977 | Aoki et al. | 58/85.5 |
| 4,123,896 | 11/1978 | Asano | 58/22.9 |

*Primary Examiner*—Edith S. Jackmon

*Attorney, Agent, or Firm*—Griffin, Branigan & Butler

[57] ABSTRACT

A countdown device such as a timer employing a digital display is provided with a plurality of up/down counters, one for each digit column. A single control switch is provided which may be in the form of a push-button and the signal obtained therefrom acts on each counter until a predetermined count is reached and then on the succeeding counter. Thereby digital data may be rapidly introduced, precision of the representation diminishing however as the interval increases.

11 Claims, 6 Drawing Figures

Osc.
Freq. Divider
1sec. 1min
Up/down (up = 1)
70
Countdown (1s or 1min)
Input
Reset CP 0÷9 Reset up/down
Carry
Decoder
Displ.
0 if = 9
1 if ≠ 9
0÷5 Up/down
0÷9 Up/Down counting steps
0 1 2 3 4 5 6 7 8 9 10 20 30 40 50 1.00 1.10 1.20 --- 9.40 9.50
minutes column
10 minutes and hours columns

| | 6A | 6B |
|---|---|---|
| 0 | 000 | 0 |
| 1 | 001 | 0 |
| 2 | 010 | 0 |
| 3 | 011 | 0 |
| 4 | 100 | 0 |
| 5 | 000 | 1 |
| 6 | 001 | 1 |
| 7 | 010 | 1 |
| 8 | 011 | 1 |
| 9 | 100 | 1 |

DATA INTRODUCING ARRANGEMENT

BACKGROUND OF THE INVENTION

This application is a continuation-in-part of application Ser. No. 897,603 filed on Apr. 18, 1978, which is now abandoned.

Watches, clocks and like instruments have long been known in which in addition to the usual time keeping function it is possible to preset the mechanism to a predetermined interval of time and upon this interval running out to generate a signal which may be applied to various ends. Most of the devices so far known are basically mechanical in their conception and rely upon traditional analogue displays both for time keeping and for presetting a desired timer interval.

With the advent of electronic timepieces including wrist watches provided with electronic digital type displays, it is desirable to be capable of providing the timer feature. Various difficulties however have arisen in this respect. Thus, for instance, should one wish to preset a given time interval into a digital display time piece, it is necessary to run through all of the counts possible in each of the counters in view of their inherent nature. Such an operation may turn out to be fairly time-consuming or when speed-up arrangements are available one risks over-shooting the desired interval. Other known arrangements involve the use of separate control switches for each digit column and these arrangements also complicate the setting procedure and as well detract from the aesthetic presentation when the timer forms part of a wrist-watch.

This invention proposes to employ a single control means to effect the introduction of long or short intervals into a countdown timer as employed with a digital display type time piece, the precision of the data representing signals thus introduced diminishing as the time interval increases. Through such means the user may benefit to a greater extent from the apparatus than hitherto usual, it being observed that the complexity of the known arrangements and the time consumed in making the settings has tended to limit their attractiveness. It appears that in most instances, short intervals, for which the precision of the present arrangement is highest, are likely to be most useful in practice.

SUMMARY OF THE INVENTION

The invention therefore comprises a data introducing arrangement for a count down device such as a timer employing a digital display and multistage up/down counting means for each ordered digit column to be displayed wherein logic means are associated with at least certain stages of each successive counting means thereby to block and bypass said certain stages during count up after reaching a predetermined count and upon triggering a succeeding counter stage, whereby a single switch suffices for rapidly introducing digital data representing a time interval, the precision of the representation diminishing as the interval increases.

Although by no means limited thereto, the arrangement of the invention may be usefully employed in wrist-watches of the digital display type and since one control switch only is required, will be particularly appreciated by the user thereof.

DETAILED DESCRIPTION OF THE INVENTION

Figures 1A, 1B, 1C:
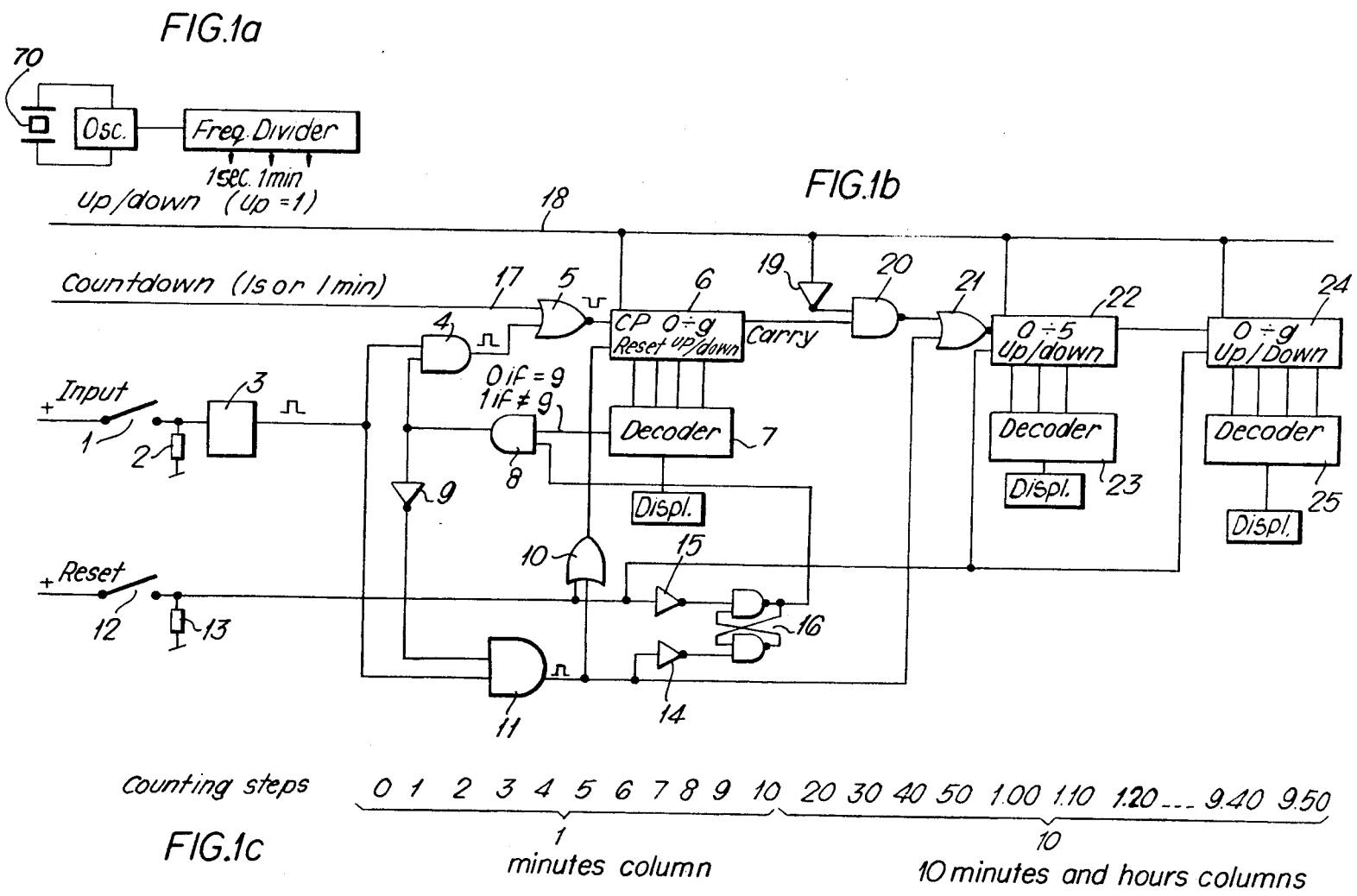
FIG. 1*a* is a block diagram depicting an oscillator and a frequency divider chain of types with which this invention is used.
FIG. 1*b* is a schematic diagram of a frequency divider chain with control circuitry of this invention integrated therewith.
FIG. 1*c* is a table illustrating the readouts of certain frequency-divider sections of the frequency-divider chain of FIG. 1*b*.

The logic shown in the FIG. 1*b*, it will be realised, forms part of an oscillator and frequency-divider of FIG. 1*a* which may be incorporated into a complete timer or time-keeping apparatus, such as a wrist-watch. Since the details of the complete apparatus are unnecessary in order to gain an understanding of the present invention they will be neither shown nor described in detail. It is sufficient perhaps to mention that as is by now well-known a timekeeping apparatus of the type envisaged may include a quartz high frequency time standard 70 (FIG. 1*a*) along with suitable frequency dividing circuits 72 followed by a display means (not shown) which in the present case would be of the digital type using either liquid crystal elements or possibly light emitting diodes.

One feature common to the circuit of the entire apparatus and the present circuit however is the presence of the several decoders 7, 23, 25 as shown in FIG. 1*b*. Additional decoders might be employed where the capacity of the display was larger and each decoder is capable of supplying information to and controlling the display in one digit column. Within the larger context of the overall timepiece the decoders receive their information from the various stages of the frequency divider associated with the quartz time standard. Although not shown here, the output of each decoder controls one digit in the display.

The present circuit thus includes a data entry switch 1 which may take the form of a push-button, such switch being coupled over an anti-rebound circuit 2 and to a pulse former circuit 3. Actuation of switch 1 may thus provide a single output pulse from circuit 3 or in certain instances circuit 3 may be adapted to provide a stream of higher frequency pulses. This latter situation would be where a high speed data entry system was desired. The output pulses from circuit 3 are fed to AND-gates 4 and 11 respectively.

Also shown is a reset switch 12 associated likewise with an anti-rebound device 13. Reset switch 12 could be a manually operated switch, but could also be automatically operated from other circuits within the overall timepiece. The effect of the reset switch 12 when actuated is to clear all counters and other circuits to their zero state whereupon new information may be readily entered. Another function of the reset signal is to assure that the latch circuit 16 will provide a "1" or high-going to AND-gate 8 for a purpose which will become evident as the description proceeds. AND-gate 8 likewise receives an output from decoder 7 and it will be realised that decoder 7 is designed to provide a "1" or high-going output for all conditions in which the information received on the decoder is not equal to "9". Under the circumstances where "9" is decoded the output from the decoder will be zero thus blocking AND-gate 8. At the start of the operations it will be seen that the counter 6 has been cleared, accordingly decoder 7 will be providing a"1" output and gate 8 will pass an enabling "1" signal to the input of AND-gate 4. Accordingly, a signal from the circuit 3 will be transmitted to NOR-gate 5.

NOR-gate 5 may receive as a second input a signal from line 17 which provides count down pulses at a predetermined rate for example one per minute or one per second. The output of NOR-gate 5 is applied to the clock input CP of an up-down counter 6. As a further input to counter 6 signals will be applied from line 18 indicative of whether the counter is to count up or down. Upon receipt of "1" signal on line 18 counter 6 will count up. The output from counter 6 is in the form of carry and is also in the form of signals applied as previously explained to decoder 7. The carry, it will be realised, is used during count down operations and is applied to a NAND-gate 20 the output of which passes through NOR-gate 21 to a second up-down counter stage 22 in this case designed to count from "0" to "5".

A further counterstage 24 along with decoder 25 is shown and still further stages may be provided should the capacity of the timer circuit require it. Although the details associated with the subsequent counterstages 22 and 24 are not shown, for example the latching circuits and the blocking circuits, it will be realised that these are basically similar to the circuits now to be described in conjunction with the first counter stage 6 whereby each counter stage in turn acts in a similar manner.

Thus, assuming that the "up" or "1" signal is present on line 18 it will be seen that the series of pulses received from circuit 3 will be transmitted through AND-gate 4 and as low-going pulses from NOR-gate 5 to step up-down counter 6 progressively through numbers "0" through "9". As the counter is stepped the contents thereof will be displayed via decoder 7 in the associated display minutes column, for example, of FIG. 1*c*. At number "9" the output from decoder 7 will change to a "0" thereby blocking AND-gate 8. The blocking signal on AND-gate 8 causes this latter to output a "0" signal thereby blocking AND-gate 4 however provides a high-going signal from inverter 9 to be applied to AND-gate 11 which is thus enabled. Accordingly, the following pulse appearing from circuit 3 will not be transmitted through AND-gate 4 but will be transmitted through AND-gate 11 and from there will be applied through inverter 14 to reset latch 16 and through NOR-gate 21 to start the counting procedure in up-down counter 22. At the same time a reset pulse will be transmitted from AND-gate 11 through OR-gate 10 into the reset input of up-down counter 6. Since latch 16 has been reset it follows that gate 8 is blocked, therefore the fact that decoder 7 will now be providing a "1" will have no significance and subsequent signals received from circuit 3 will continue to be transmitted through AND-gate 11. Thus during this subsequent stage of counting up-down counter 6 is completely bypassed whereby up-down counters 22 and 24 which operate together continue to accumulate counts until they too have reached their capacity whereupon a similar circuit arrangement may be provided to assure that counters 6, 22 and 24 are bypassed and the signals provided from circuit 3 are transmitted to a further up-down counter (not shown).

The counts of the counters 22 and 24 are shown in the "10 minutes and hours columns", for example, of FIG. 1*c*.

It follows that it is unnecessary to pass through every stage of every counter in order to accumulate a large count in the overall timer since each individual counter is filled and thereafter cleared and bypassed.

Figures 2A, 2B, 2C:
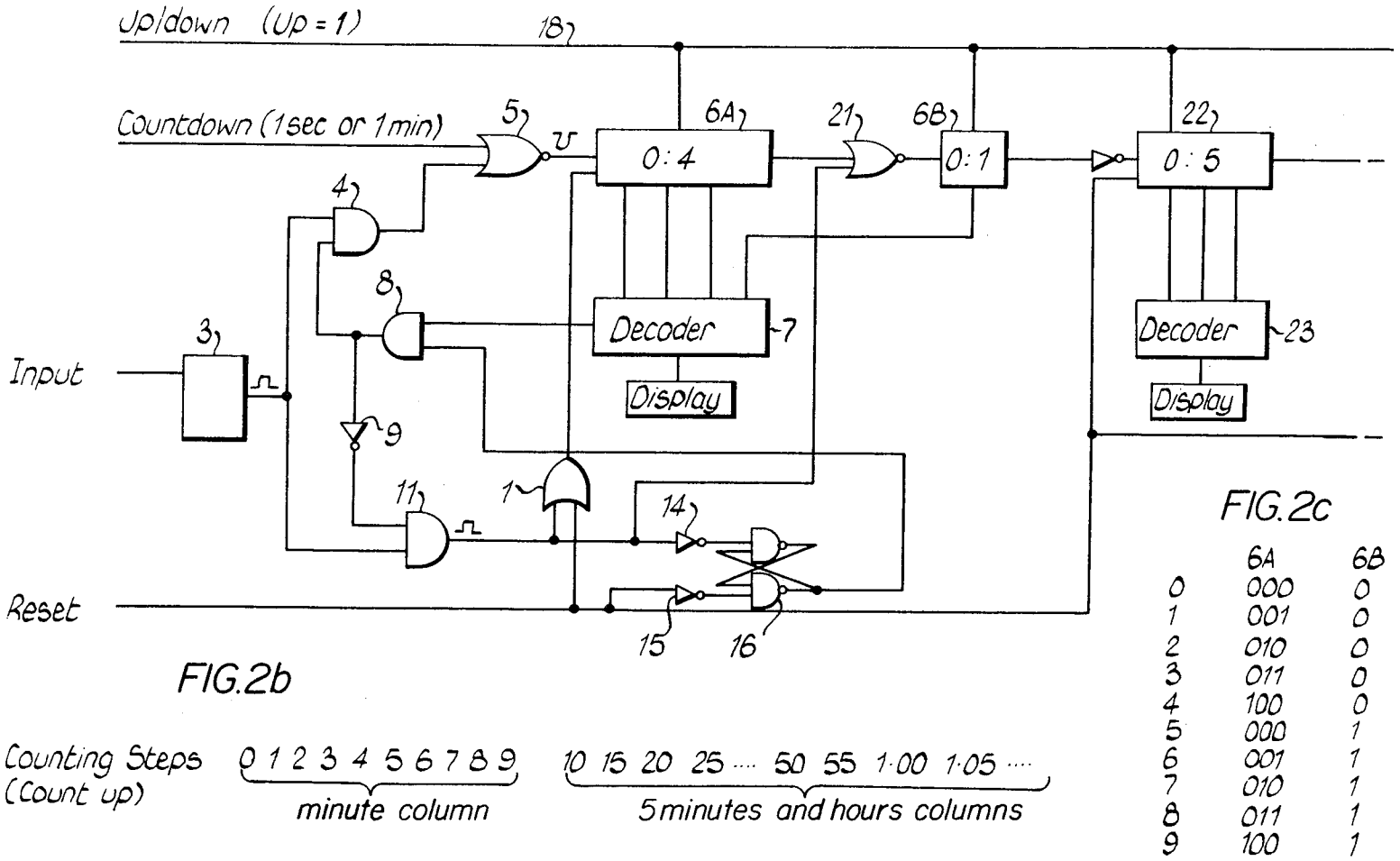
FIG. 2*a* is a schematic diagram of a frequency divider chain with a second-embodiment control circuitry of this invention integrated therewith.
FIG. 2*b* is a table illustrating the readouts of certain frequency-divider sections of the frequency-divider chain of FIG. 2*a;*
FIG. 2*c* is a table illustrating binary counts on the counting stages of counter sections 6A and 6B in FIG. 2*a* upon receipt of a series of pulses.

For count-downs it will be seen that the signal on line 18 is inverted whereby the several counterstages now count down rather than up. During count-down however, it will be clear that the several bypass circuits will not be in operation whereby the counting will proceed through every single stage. During count-down timing signals are applied via line 17 and NOR-gate 5 to counter 6. Since signals are not received from the input circuits 1, 2 and 3 there is no importance as to the nature of signals being produced from decoder 7 and applied through AND-gates 8, 4, 11 etc. The fact that the signal on line 18 is "0" will enable via inverter 19 NAND-gate 20 whereby the carry signal from up-down counter 6 is passed to NOR-gate 21 to subsequently act on up-down counter 22 and 24 it being realised that a similar circuit arrangement will be likewise provided in respect of up-down counters following counter 24. The FIG. 2*a* embodiment of the invention is quite similar to FIG. 1*b*, but provides a greater precision. Thus, in FIG. 1*b*; following filling of the first counter 6 precision drops to ten minute intervals and thereafter hour intervals. By dividing counter 6 into two sections 6A and 6B it is possible to obtain precision of 5 minute intervals. Thus, section 6A may comprise three counter stages while section 6B comprises a single stage. A quibinary coding may be employed as shown in the table of FIG. 2*c* whereby section 6A stores binary bits and alone may count from 0–4, section 6B stores the quinary count 5 bit and the two sections together count from 0–9 as in the FIG. 1 embodiment. Decoder 7 receives inputs from both section 6A and 6B and otherwise functions as in FIG. 1 to provide the "minutes column" readout, for example, of FIG. 2*b*.

Thus, when a count of 9 is decoded AND-gate 8 is blocked and AND-gate 11 is enabled whereby the next succeeding input resets counter section 6A, changes from 1 to 0 the quinary bit in section 6B and provides a carry to commence the count in tens-of-minutes counter 22. Succeeding inputs thereafter bypass section 6A while the quinary bit counter 6B alternates from 1 to 0 and provides a carry at each zero changeover thereby to augment the count in counter 22 to provide the "5 minutes and hours columns" readout, for example, of FIG. 2*b*.

Count down operations proceed in the same manner as in the FIG. 1 embodiment and again the bypass logic becomes inoperative whereby counting goes through all stages.

There has thus been described a simple arrangement by which a counter within a timer apparatus may be rapidly filled but discharged at the normal rate, thereby rendering said counter more convenient to the user thereof.

Other schemes following the foregoing teaching may suggest themselves to persons skilled in the art. Thus in place of the random logic array as shown in the drawings it is readily conceivable to replace the entire circuit by a microprocessor of which several types are by now well known and commercially available. In such an arrangement the functions as previously described will be incorporated into a read-only memory progam which will provide the appropriate instructions to control the necessary bypass functions at the appropriate time in response to a macro instruction provided as in the present case by an externally accessible switch.

What we claim is:

1. A data introducing arrangement including a quantity measuring count-down digital display device for displaying a plurality of ordered columns of digits representative of the quantity, such as a timer, comprising:

a multi-stage down counting means having a group of counting stages for each ordered digit column to be displayed, said multi-stage down counting means being set to a predetermined set count by activating stage groups of said multi-stage down counting means with setting pulses until said predetermined set count is reached, and said multi-stage down counting means measuring said quantity by thereafter counting downwardly, from said predetermined set count, pulses representative of said quantity;

a setting pulse producing system for initially feeding setting pulses to a stage group corresponding to a lower order digit column when said multi-stage down counting means is being set at said predetermined set count;

a logic means connected between said pulse producing system and said down counting means to block setting pulses fed to said stage group corresponding to said lower order digit column and to thereafter bypass said lower order stage group to feed said setting pulses to a stage group of a higher order digit column in response to said lower order stage group reaching a predetermined trigger count unrelated to said set count.

2. A data introducing arrangement as in claim 1 wherein said logic means is coupled with all stage groups of the counting means.

3. A data introducing arrangement as in claim 2 wherein the lowest order counting stage group may register counts of 0–9 representing minutes, the succeeding counting stage group may register counts of 0–5 representing tens of minutes while thereafter succeeding counting stage groups may represent hours and tens of hours.

4. A data introducing arrangement as in claim 1 wherein a decoding means for decoding said count and providing electrical signals representative thereof is coupled between said lower-order counting stage group and said logic means and wherein a display means for displaying said count is also coupled to said decoding means whereby the count contents may be displayed and control signals generated to said logic means in accordance with said count contents.

5. A data introducing arrangement as in claim 4 wherein said logic means includes an input gating means for allowing pulses to flow to said lower order stage group when enabled, a bypass gating means for transmitting pulses around said lower order stage group to a higher order stage group when enabled and a latch circuit coupled between said input and bypass gating means and coupled to said decoding means, the state of the latch circuit and decoding means serving to determine the enabling of one or the other of said gating means.

6. A data introducing arrangment as in claim 5 wherein a futher input gating arrangement couples each successive counting stage group with the preceding lower order stage group, said further input gating arrangement being enabled when said counting means are set to measure said quantity by counting.

7. A data introducing arrangement as in claim 1 wherein the counting stage group corresponding to the lowest ordered digit column comprises four stages said logic means being associated with three of said four stages whereby an initial count of 0–9 may be registered followed by successive counts of 0 and 5 corresponding to the output of the fourth stage said counts representing minutes, while succeeding counting means may represent tens of minutes and hours.

8. A data introducing arrangement as in claim 1 wherein said count down device is incorporated into an electronic timepiece employing a quartz time standard.

9. A data introducing arrangement as in claim 8 wherein said timepiece is a wrist-watch.

10. A data introducing arrangement as in claim 1 wherein said setting pulse producing system and said logic means are actuated by a single on/off switch.

11. A data introducing arrangement as in claim 1 wherein said multi-stage down counting means counts upwardly when it is being set and downwardly when it is measuring said quantity.

* * * * *

UNITED STATES PATENT AND TRADEMARK OFFICE

CERTIFICATE OF CORRECTION

PATENT NO. : 4,255,805

DATED : May 10, 1981

INVENTOR(S) : Jean-Pierre Jaunin

It is certified that error appears in the above—identified patent and that said Letters Patent is hereby corrected as shown below:

In the drawings, Sheet 1, Fig. 1a, the reference numeral 72 should be applied to the element labeled "Freq. Divider".

Signed and Sealed this

*Eighteenth* Day of *August 1981*

[SEAL]

*Attest:*

GERALD J. MOSSINGHOFF

*Attesting Officer*

*Commissioner of Patents and Trademarks*